United States Patent [19]

Latassa

[11] 4,056,750

[45] Nov. 1, 1977

[54] MERCURY DISPENSER FOR DISCHARGE LAMPS

[75] Inventor: Frank M. Latassa, Magnolia, Mass.

[73] Assignee: GTE Sylvania Incorporated, Danvers, Mass.

[21] Appl. No.: 751,835

[22] Filed: Dec. 17, 1976

[51] Int. Cl.[2] ..... H01J 61/28

[52] U.S. Cl. ..... 313/177; 313/174

[58] Field of Search ..... 313/177, 174, 176, 180

[56] References Cited

U.S. PATENT DOCUMENTS 3,764,842 10/1973 Ridders et al. ..... 313/177

3,794,403 2/1974 Ridders et al. ..... 313/177 X

*Primary Examiner*—Rudolph V. Rolinec

*Assistant Examiner*—Darwin R. Hostetter

*Attorney, Agent, or Firm*—James Theodosopoulos

[57] ABSTRACT

A mount for an arc discharge lamp has a cathode thereon which is encircled by a disintegration shield. The shield has a narrow gap between its ends with a mercury containing metal capsule in the gap. The lower portion of the capsule is connected to the ends of the shield so that when an Rf current is induced in the shield, it preferentially flows through the lower portion of the capsule.

2 Claims, 2 Drawing Figures

MERCURY DISPENSER FOR DISCHARGE LAMPS

THE INVENTION

This invention is concerned with low pressure arc discharge lamps, particularly fluorescent lamps, which contain mercury. It is especially concerned with the means by which the mercury is introduced into the lamp.

The most commonly used method for introducing mercury into a lamp is a mechanical dispensing system. Mercury is dispensed by the action of a slotted plunger passing through a reservoir of mercury and into the closed exhaust chamber housing the lamp exhaust tube. The mercury falls through the exhaust tube into the lamp. This method lacks good control over the quantity of mercury dispensed into the lamp and requires costly periodic filling and cleaning of the mercury dispensers.

Another method of dispensing mercury, shown in U.S. Pat. Nos. 3,657,589 and 3,728,004, is to place inside the lamp a mercury compound that is inert under lamp processing conditions but can later be activated to release mercury. Disadvantageously, this method releases impurities, which then require special gettering. It also requires a relatively long time (20 to 30 seconds) to activate the mercury compound which does not readily lend itself to high speed machine production.

A third method involves the use of mercury containing capsules which are subsequently ruptured to release the mercury. Examples are in U.S. Pat. Nos. 2,288,253, 2,415,895, 3,300,037, 3,764,842, 3,794,402, 3,895,709, 3,913,999, and 3,983,439. These examples either require special heaters proximate the capsule or provide loose capsule particles within the lamp or dislodge phosphor coating upon capsule rupture or do not lend themselves to high speed machine production.

It is an object of this invention to provide a mercury dispenser in a discharge lamp which overcomes the disadvantages of prior art dispensers and is usable on high speed lamp manufacturing equipment.

This invention provides a mercury containing metal capsule which is welded across a gap in the disintegration shield of a discharge lamp in such a manner that upon rupture of the capsule the mercury is directed towards the end of the lamp.

Figure 1:
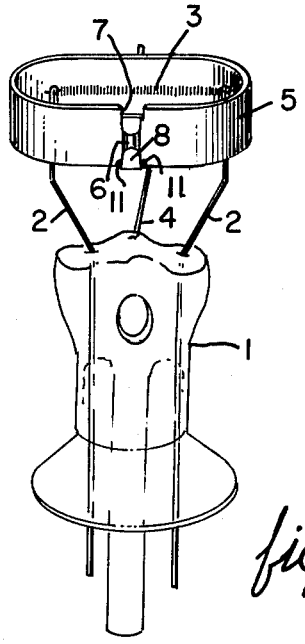
FIG. 1 is a perspective view of a discharge lamp mount embodying a mercury containing capsule in accordance with this invention.
Figure 2:
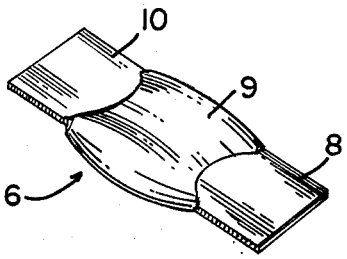
FIG. 2 is an enlarged perspective view of the capsule.

As shown in the drawing, glass mount 1 of an arc discharge lamp has lead-in wires 2 embedded therein, cathode 3 being mounted on wires 2. Surrounding cathode 3 is a metal disintegration shield 5 which is supported by wire 4 embedded in mount 1. Shield 5 completely encircles cathode 3 except for a small gap 7 between the ends of shield 5. Bridging gap 7 is a mercury containing metal capsule 6.

In one example, capsule 6 was made by filling (for example, by vacuum) with mercury a 12 inch long stainless steel tube, 50 mil O.D. by 1 mil wall thickness. The filled tube was then crimped and cut at intervals along its length to provide capsules 6 each having a flat crimped portion 8 about 2 mm long, an uncrimped mercury containing portion 9 about 2 mm long, and another flat crimped portion 10 also about 2 mm long. The width of crimped portions 8 and 10 is also about 2 mm wide. Uncrimped portion 9 contains about 15 mg of mercury.

Capsule 6 was welded across gap 7 at about the corners 11 of flat crimped portion 8, gap 7 being narrower than 2 mm. Flat crimped portion 8 was more proximate mount 1 than flat crimped portion 10 so that, in the lamp, portion 8 substantially points toward the end of the lamp, away from the main body and the walls.

After the lamp is sealed, the mercury can be released by RF induction heating shield 5. The induced current flowing across gap 7 preferentially flows through flat crimped portion 8 because of the welds to shield 5 at corners 11. The induced current causes flat crimped portion 8 to split or rupture, thereby releasing the mercury in the direction of the end of the lamp.

In another embodiment, each side of flat crimped portion 8 may be welded to a small tab and the tabs may then be welded directly to the ends of shield 5. In this embodiment the width of gap 7 is less critical.

I claim:

1. In an arc discharge lamp having a glass mount at one end with a cathode supported on the mount, the improvement comprising a disintegration shield encircling the cathode except for a narrow gap between the ends of the shield, a mercury containing metal capsule disposed in the gap and electrically connected to the ends of the shield, the portion of the capsule that is connected to the ends of the shield being the lower portion thereof which is more proximate the mount so that when an RF current is induced in the shield the current flow through the capsule primarily occurs through said lower portion.

2. The improvement of claim 1 wherein said lower portion is a flat crimped portion and is the first part of the capsule to rupture when sufficient rupturing current flows through the capsule.

* * * * *